US007402115B2

(12) United States Patent
Moussa

(10) Patent No.: US 7,402,115 B2
(45) Date of Patent: Jul. 22, 2008

(54) GAME PLAYED BY A GOLF FOURSOME DURING A ROUND OF GOLF

(75) Inventor: Jesse Moussa, Camrose (CA)

(73) Assignee: Inside Touch Inc., Edmonton, Alberta (CA)

( * ) Notice: Subject to any disclaimer, the term of this patent is extended or adjusted under 35 U.S.C. 154(b) by 0 days.

(21) Appl. No.: 11/846,693

(22) Filed: Aug. 29, 2007

(65) Prior Publication Data

US 2007/0290445 A1 Dec. 20, 2007

Related U.S. Application Data

(62) Division of application No. 11/214,361, filed on Aug. 29, 2005, now abandoned.

(51) Int. Cl.
*A63B 57/00* (2006.01)
*A63F 9/04* (2006.01)

(52) U.S. Cl. ..... 473/409; 473/131; 273/146

(58) Field of Classification Search ..... 473/131, 473/405, 407, 409; 273/146
See application file for complete search history.

(56) References Cited

U.S. PATENT DOCUMENTS 1,492,737 A 5/1924 Meyer
D175,740 S * 10/1955 Preston ..... D21/373
4,927,147 A 5/1990 Delzio
5,000,460 A 3/1991 Barbiaux et al.
5,234,218 A 8/1993 LaRocca
5,884,915 A * 3/1999 Koziol ..... 273/146
5,918,881 A 7/1999 Kirby
6,047,967 A 4/2000 Murphy et al.
6,105,963 A * 8/2000 Dontfraid ..... 273/245
6,193,233 B1 2/2001 Lipman
6,209,870 B1 4/2001 Shea et al.
2002/0105140 A1 8/2002 Field
2003/0025269 A1 2/2003 Stranger
2005/0023751 A1 * 2/2005 Paterson ..... 273/146
2005/0187029 A1 8/2005 Kimmel

* cited by examiner

*Primary Examiner*—Steven Wong
(74) *Attorney, Agent, or Firm*—Davis Bujold & Daniels, P.L.L.C.

(57) ABSTRACT

A combination golf and dice game for a golf foursome comprising a first die and a second dice. The first die has different indica defining specified pairings of the foursome while the second die has different indicia defining at least one of a skill challenge(s) and scoring rules for the game. A player rolls the pair of dice to obtain both the specified pairing of the foursome being dictated by the first die such that a first team competes against a second team under one of the specified skill challenges and scoring rules of the game dictated by the second dice. A method of playing the game for a golf foursome is also disclosed.

4 Claims, 2 Drawing Sheets

GAME PLAYED BY A GOLF FOURSOME DURING A ROUND OF GOLF

This application is a divisional application of U.S. patent application Ser. No. 11/214,361, filed Aug. 29, 2005, now abandoned.

FIELD OF THE INVENTION

The present invention relates to a game expressed intended to be played by a golf foursome during their round of golf, which game may or may not include a wager.

BACKGROUND OF THE INVENTION

Golf is an extremely popular game. There have been numerous games developed which "simulate" the game of golf, such as U.S. Pat. No. 6,047,967 to Murphy et al., and U.S. Pat. No. 5,234,218 to LaRocca.

SUMMARY OF TEE INVENTION

According to the present invention there is provided a game to be played by a golf foursome during a round of golf. The game includes instructions outlining a number of golf contests, intended to make the round of golf more entertaining, in the form of skills, challenges, or scoring options. The instructions instruct the players to compete in golf pairings and randomly select one of the golf contests prior to beginning each golf hole.

BRIEF DESCRIPTION OF THE DRAWINGS

These and other features of the invention will become more apparent from the following description in which reference is made to the appended drawings, the drawings are for the purpose of illustration only and are not intended to in any way limit the scope of the invention to the particular embodiment or embodiments shown, wherein.

DETAILED DESCRIPTION OF THE PREFERRED EMBODIMENT

The preferred embodiment, a game intended to be played by a golf foursome during a round of golf will now be described with reference to sample set of instructions and selection dice illustrated in FIG. 1 through 4.

Figure 1:
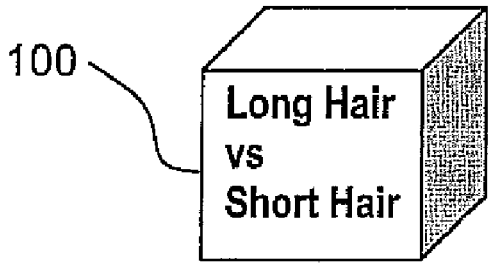
FIG. 1 is a perspective view of a golf pairings selection dice constructed in accordance with the teachings of the present invention.
Figure 2:
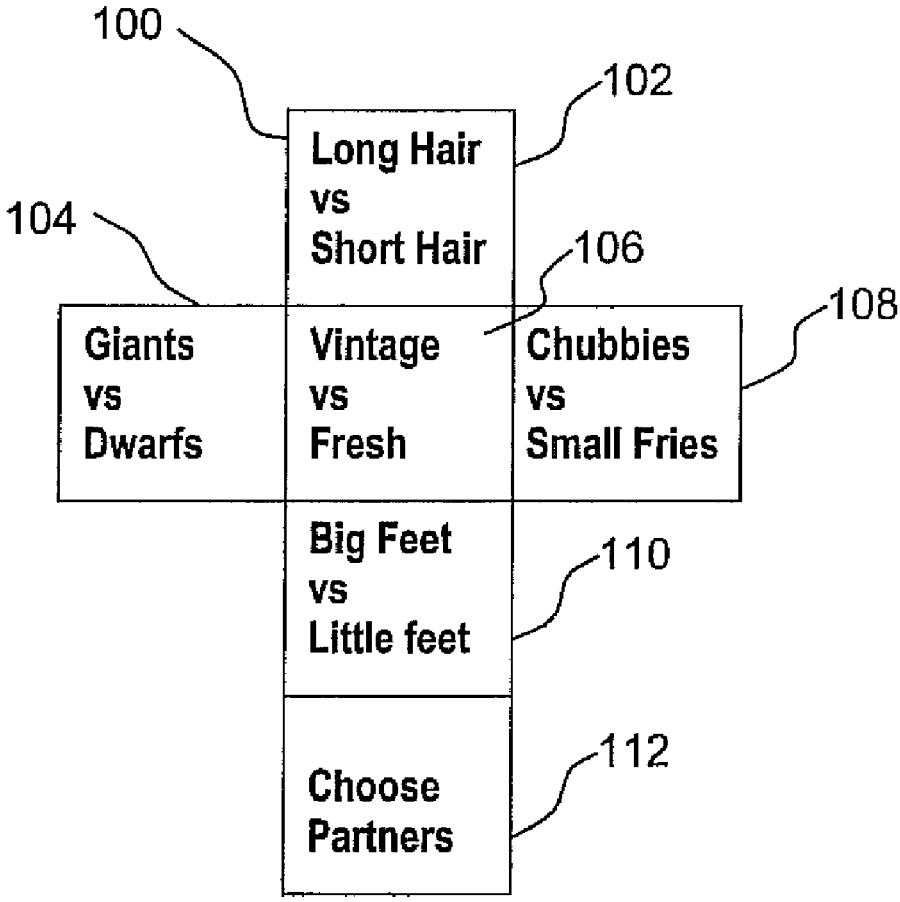
FIG. 2 is a pattern view of the golf pairings selection dice illustrated in FIG. 1, so that all sides can be viewed at once.
Figure 3:
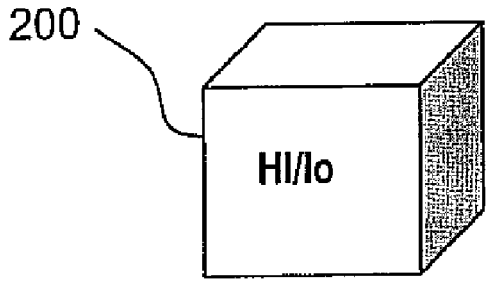
FIG. 3 is a perspective view of a golf contest selection dice constructed in accordance with the teachings of the present invention.
Figure 4:
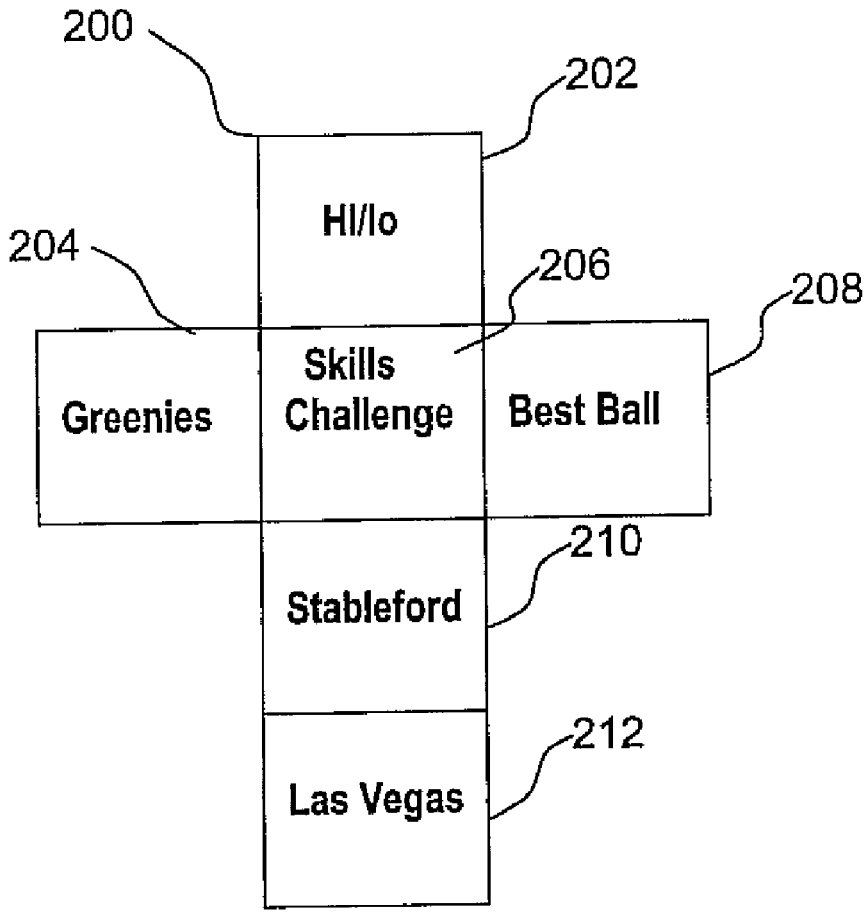
FIG. 4 is a pattern view of the golf contest selection dice illustrated in FIG. 3, so that all sides can be viewed at once.

The game includes instructions and two dice: a golf pairings selection dice 100 shown in FIGS. 1 and 2, and a golf contest selection dice 200 shown in FIGS. 3 and 4.

On the first tee one player in the foursome rolls both dice to begin the game. Golf pairings selection dice 100 determines the partners while golf contest selection dice 200 determines the game to be played for that hole. As each die is six sided, there are 36 different combinations. Dice 100 and 200 are rolled on each tee, rotating through all four players.

An example of the presentation of the game may have dice 100 and 200 as different colors, such as blue and red, respectively. Dice 100 and 200 come in a faux velvet bag with drawstring (not shown), are made of polyurethane foam or other such material, and about 2 inches on each side with rounded corners with debossed or inscripted print on each side.

Each player accumulates points when their team wins a hole and/or when points are awarded individually in certain games. Make sure you are clear on the bet value of points to be won before you tee off. At the end of the round each player in the foursome adds up the points they have accumulated, both as individuals and as team players. Their total is compared to that of the other players, and rewarded accordingly. For example, if there was a friendly wager, each person would pay what he or she owes to the others.

Referring to FIG. 2, there are 6 example pairings on die 100. The pairings include: long hair vs. short hair 102 (the two players with the longest hair team up against the two with the shortest hair), giants vs. dwarfs 104 (the tallest players pair up against the shortest), vintage vs. fresh 106 (the oldest players pair up against the youngest), chubbies vs. small fries 108 (the heaviest players pair up against the lightest), big feet vs little feet 110 (the two players with the largest feet pair up against the two with the smallest feet), and choose partners 112 (foursome's choice).

Referring to FIG. 4, there are 6 example games on die 200, one of which is to be played on a hole. The games include hi/lo 202, greenies, 204, skills challenge 206, best ball 208, Stableford 210, and Las Vegas 212. Details on the games are given below, with an example method of scoring.

Hi/Lo 202: In this game each player on a team plays their own ball and their scores are totaled to give a team score. If player A gets 4, and player B gets 5, the team score is 9. The team with the lowest total wins the hole. A point is added to the winning team's individual totals.

Greenies 204: In this game, one good shot on the hole can help your team win a bet point. Points or nibs are won by individual players as follows:

hitting the fairway=1 point
closest to the pin=1 point
a Sandy (up and down from a bunker—ie out of a sand trap and into the hole in two shots)=1 point
first player in the hole=1 point Other shots could be added to this list, and point values may vary based upon relative difficulty. Individual points won on the hole are tallied for a team total to determine which team won the hole. The players of the winning team add an additional point to their individual point totals. In the case of a tie between golf pairings, individual player points are awarded, but no golf paring team points are awarded.

Skills Challenge 206: Points or nibs are won by individual players as follows:

longest drive=1 point
straightest drive=1 point
fewest putts=1 point
lowest score on the hole=1 point Individual points won on the hole are tallied for a team total to determine which team won the hole. The players of the winning team add an additional point to their individual point totals. Other skills challenges could include: hitting the fairway, straightest drive, closest to the pin, first player in the hole, or out of a sand trap and into the hole in two shots. Again, in the case of a tie, individual points are awarded but no golf pairing team points are awarded.

Best Ball 208: Each player on the team plays his or her own golf ball throughout the hole, and the low score or "best ball" of the two players serves as the team score. If Player A gets a 5 and B gets a 4, then the team score for that hole is 4. The team with the lowest best ball adds a point to each of their individual totals for winning the hole.

Stableford 210: In a Stableford competition the golfers are awarded scores based on their performance, In this embodiment, a Modified Stableford version is used:

Double eagle: 8 points
Eagle: 5 points
Birdie: 3 points
Par: 2 points
Bogey: 1 point
Double bogey or worse: 0 points If your foursome chooses they can use their handicaps accordingly. Each player plays their own ball and both player's Stableford points are added together. The team with the highest combined Stableford score, adds a point to their individual totals for winning the hole.

Las Vegas 212: In Las Vegas, each player plays their own ball and the two player's scores are combined or paired together to give a team total. The scores are not added together as in HI/Lo. If Player A gets a 4 and Player B gets a 5, the team score is 45 (the lower number goes first). If both players get 4s, that's 44; if one gets an 8 and the other gets a 3, that's 38. The team with the lowest paired score wins the hole and a point is added to each individual total. Another option is to take the difference between the team totals, which then determines the number of points won on the hole. For example: Team A scores 44 and Team B scores 38; each player on Team B wins 6 points.

These instructions outline a number of golf contests, intended to make the round of golf more entertaining. These golf contests are in the form of both skills challenges and scoring options. The instructions direct that the players randomly select one of the golf contests prior to beginning each golf hole. A random golf contest selection device is provided in the form of die 200. It will be appreciated that other forms of random selection device could be alternatively used, and that other contests may be incorporated In view of the fact that the golf pairings will be continually changing, it may be preferable that points be awarded to each player based upon his or her individual performance on the skills challenges and points be awarded to each player in each of the golf pairings based upon the relative performance of their golf pairings.

The above game rules are a sample of a game intended to be played by a golf foursome during a round of golf. The instructions instruct the golfers to randomly select golf pairings prior to beginning each golf hole, such that the golf pairings change during the round of golf. Referring to FIGS. 1 and 2, a random golf pairing selection device is provided in the form of a die 100. As mentioned above, other forms of random selection device could alternatively be used. Referring to FIG. 2, some examples of pairings are: long hair vs. short hair 102 (the two players with the longest hair team up against the two with the shortest hair), giants vs. dwarfs 104 (the tallest players pair up against the shortest), vintage vs. fresh 106 (the oldest players pair up against the youngest), chubbies vs. small fries 108 (the heaviest players pair up against the lightest), big feet vs little feet 110 (the two players with the largest feet pair up against the two with the smallest feet), and choose partners 112 (foursome's choice). Other partnering options may also be incorporated.

In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be one and only one of the elements.

It will be apparent to one skilled in the art that modifications may be made to the illustrated embodiment without departing from the spirit and scope of the invention as hereinafter defined in the Claims.

What is claimed is:

1. A method of playing a combination golf and dice game for a golf foursome, the method comprising the steps of:

marking on a first dice different indica defining a specified pairing of players of the golf foursome;

marking on a second dice different indicia defining at least one of skill challenges and scoring rules for the game;

throwing the first die and the second die before beginning a golf hole;

selecting first and second pairing based upon the throw of the first die, and competing the first pairings of the foursome against the second pairing under one of the specified skill challenges and scoring rules of the game based upon the throw of the second die.

2. The method of playing a combination golf and dice game for a golf foursome as set forth in claim 1 further comprising the step of rolling the first and second dice prior to the foursome playing each golf hole of the game so that the first and the second pairings of the foursome may change throughout the game.

3. The method of playing a combination golf and dice game for a golf foursome as set forth in claim 1 further comprising the step of marking one or more of the following on the second die: hitting a fairway, longest drive, straightest drive, closest to a pin, first player in a hole, fewest puts, out of a sand trap and into a hole in two shots, or lowest score on a hole.

4. The method of playing a combination golf and dice game for a golf foursome as set forth in claim 1 further comprising the step of marking one or more of the following on the second die: a cumulative total of golf scores of both players in each of the first and the second pairings, a single lowest score per hole for each of the first and the second pairings, a stableford score for both players in each of the first and the second pairings, or two digit score formed by using a golf score of each player to represent one digit.

* * * * *